US007603931B1

(12) United States Patent
Powell

(10) Patent No.: US 7,603,931 B1
(45) Date of Patent: Oct. 20, 2009

(54) ANGULARLY OFFSET WRENCH

(76) Inventor: Paul Powell, P.O. Box 253, Castleberry, AL (US) 36432

( * ) Notice: Subject to any disclaimer, the term of this patent is extended or adjusted under 35 U.S.C. 154(b) by 0 days.

(21) Appl. No.: 11/986,633

(22) Filed: Nov. 26, 2007

(51) Int. Cl.
*B25B 23/00* (2006.01)

(52) U.S. Cl. ..... 81/439; 81/177.2; 81/177.5

(58) Field of Classification Search ..... 81/426, 81/439, 438, 177.1, 177.2, 124.7, 177.5, 81/436
See application file for complete search history.

(56) References Cited

U.S. PATENT DOCUMENTS

| | | | | |
|---|---|---|---|---|
| 3,113,479 | A | 12/1963 | Swingle | |
| 3,424,212 | A | 1/1969 | Kemper | |
| 4,246,811 | A | 1/1981 | Bondhus et al. | |
| 6,314,844 | B1 | 11/2001 | Warner | |
| 6,349,624 | B1 | 2/2002 | Fahringer | |
| 6,443,039 | B1 | 9/2002 | Warner | |
| 6,675,678 | B2 | 1/2004 | Liu | |
| 6,688,196 | B2 | 2/2004 | Warner | |
| 2006/0288823 | A1* | 12/2006 | Schepman | 81/60 |
| 2007/0131066 | A1* | 6/2007 | Burwell | 81/124.4 |

* cited by examiner

*Primary Examiner*—D. S Meislin
(74) *Attorney, Agent, or Firm*—George L. Williamson

(57) ABSTRACT

Apparatus and method for a T-shaped wrench having three drive stems including a base drive stem wherein the top portion of the wrench has opposing ends or drive stems which are 30 degrees offset from each other. The angularly offset drive stems of the top portion allow the wrench to be used in tight areas where other wrenches are not usable.

7 Claims, 2 Drawing Sheets

ANGULARLY OFFSET WRENCH

BACKGROUND OF THE INVENTION

1. Field of the Invention

The present invention generally relates to tools and, more particularly, is related to a wrench having angularly offset drive stem heads.

2. Description of the Prior Art

Wrenches have been described in the prior art, however, none of the prior art devices disclose the unique features of the present invention.

In U.S. Pat. No. 6,443,039, dated Sep. 3, 2002, to Warner, wrenches having two driving stems pivotally connected with each other were disclosed.

In U.S. Pat. No. 6,688,196, dated Feb. 10, 2004, to Warner, wrenches having two driving stems pivotally connected with each other were disclosed.

In U.S. Pat. No. 6,675,678, dated Jan. 13, 2004, to Liu, a hex wrench assembly was disclosed.

U.S. Pat. No. 6,349,624, dated Feb. 26, 2006, to Fahringer, disclosed a sprinkler tool.

U.S. Pat. No. 3,113,479, dated Dec. 10, 1963, to Swingle, disclosed a T-handle for tools.

In U.S. Pat. No. 3,424,212, dated Jan. 28, 1969, a screw wrench device was disclosed.

In U.S. Pat. No. 6,314,844, dated Nov. 13, 2001, to Warner, a uni-hex key wrench was disclosed.

In U.S. Pat. No. 4,246,811, dated Jan. 27, 1981, to Bondhus, et al., a ball-head polygonal wrench was disclosed.

While these wrenches may be suitable for the purposes for which they were designed, they would not be suitable for the purposes of the present invention, as hereinafter described.

SUMMARY OF THE PRESENT INVENTION

The present invention discloses a T-shaped hex wrench having three drive stems including a base drive stem which is hexagonal shaped wherein the top portion of the wrench has opposing ends or drive stems which are hexagonal shaped and are 30 degrees offset from each other. The angularly offset drive stems of the top portion allow the wrench to be used in tight areas where other hex wrenches are not usable.

An object of the present invention is to provide a hex wrench having angularly offset drive stems so that it can be used in areas which are small and where other L shaped hex wrenches are not usable. Another object of the present invention is to provide a wrench which can be easily and relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with references to the accompanying drawings in which.

LIST OF REFERENCE NUMERALS

Figure 1:
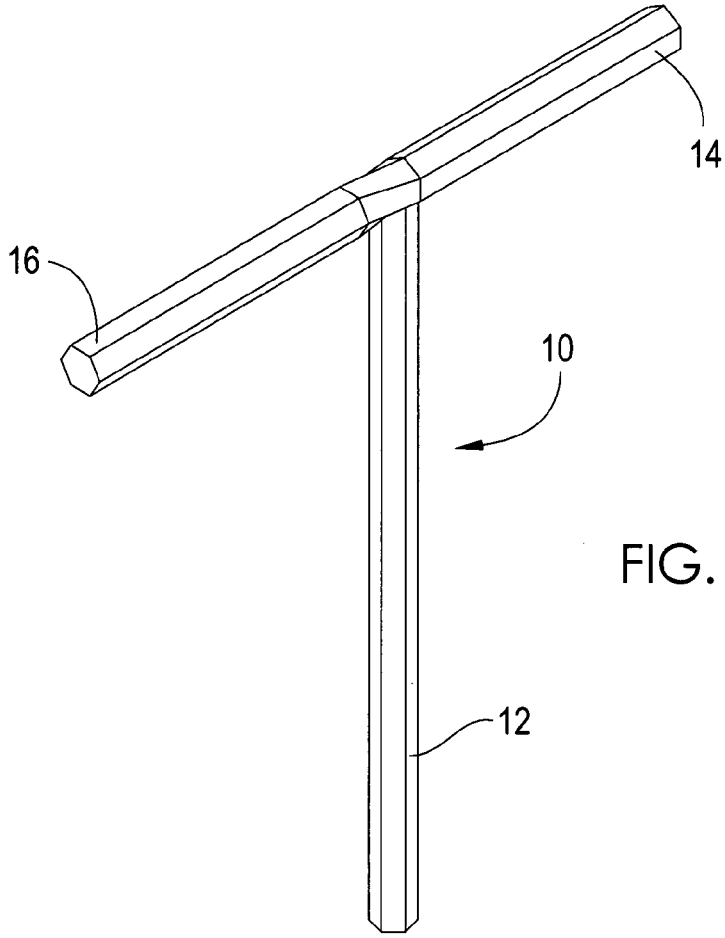
FIG. 1 is a perspective view of the present invention.

With regard to reference numerals used, the following numbering is used throughout the drawings.

10 present invention
12 base stem
14 first end
16 second end
18 allen screw
20 allen screw
22 degree reading
24 proximate object
26 position dot
28 socket of screw

DETAILED DESCRIPTION OF THE PREFERRED EMBODIMENT

The following discussion describes in detail the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1-8 illustrate the present invention wherein a wrench having angularly offset drive stems is disclosed.

Turning to FIG. 1 therein is shown the present invention 10 being T-shaped and on the base or lower end having a drive stem 12 and on the upper cross member or end, or, the top portion having a first drive stem 14 and second drive stem 16 which are angularly offset 30 degrees from each other. Note that the three portions or drive stems of the T-shaped hex wrench 12, 14, 16 each have hex shaped ends or drive stems on them, however, any polygonal shape could be used.

Figure 2:
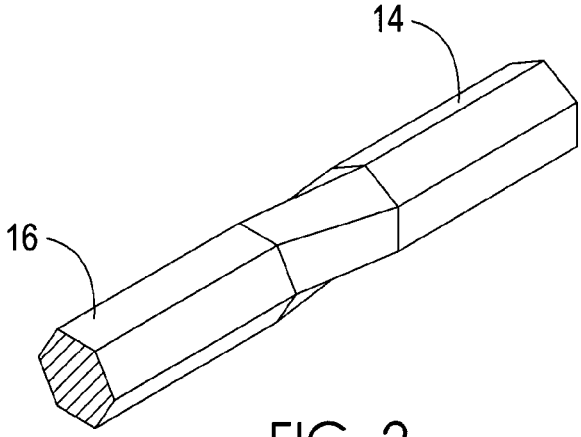
FIG. 2 is a perspective view of the top portion of the present invention.

Turning to FIG. 2, therein is shown the top of the T-portion having a first end 14 and second end 16 which are angularly offset 30 degrees from each other.

Figure 3:
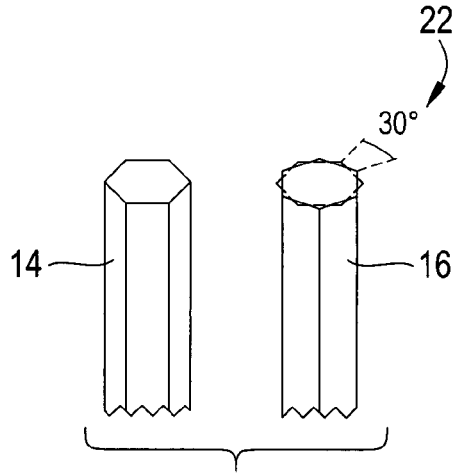
FIG. 3 is a perspective view of portions of the present invention.

Turning to FIG. 3, therein is shown a first end 14 and second end 16 indicating at 22 that they are angularly offset 30 degrees from each other.

Figure 4:
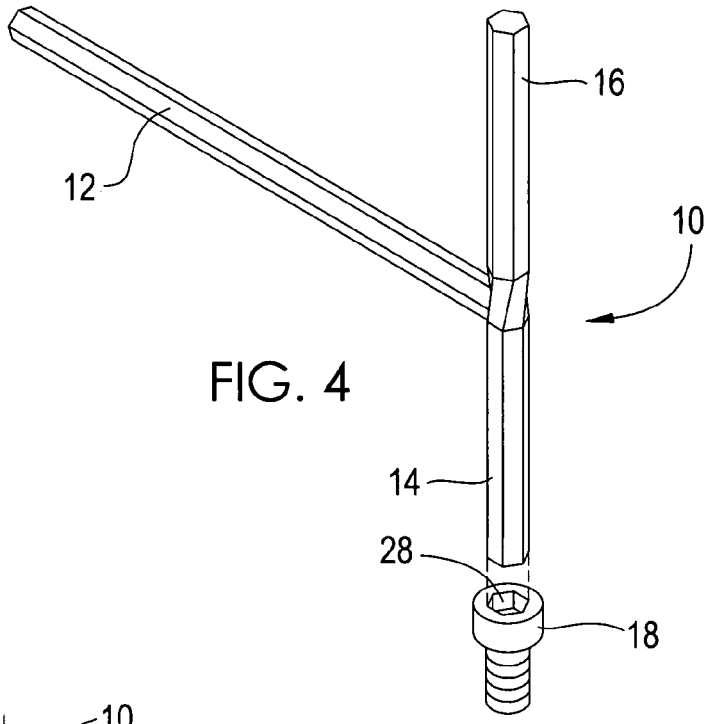
FIG. 4 is a perspective view of the present invention in operative connection.

Turning to FIG. 4, therein is shown the present invention 10 showing one end 14 of the top portion being inserted into the hex portion or drive socket 28 of an allen screw 18 in the conventional manner. It can be seen that the second end 16 is angularly offset from end 14. Therefore, if a user was holding the base stem 12 in his hand and had one stem 14 in use in the socket 28 of a screw 18 in the conventional manner, the user would only have to remove the stem 14 from the screw socket, then rotate the base stem 180 degrees in his hand, and then reposition drive stem 16 in the screw socket by rotating the base stem backwardly 30 degrees in the horizontal plane in order to then rotate the screw an additional 30 degrees.

Figure 5:
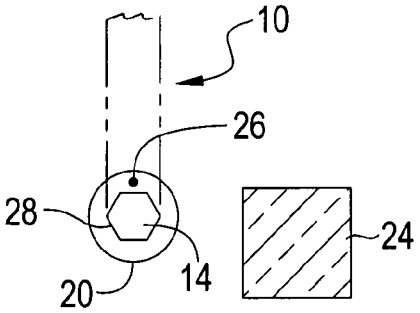
FIG. 5 is a plan view of portions of the present invention in operative connection.
Figure 6:
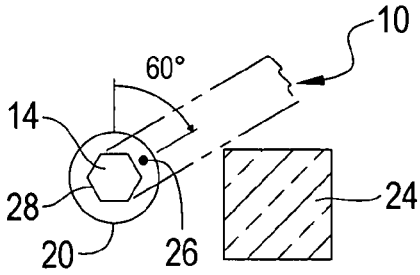
FIG. 6 is a plan view of portions of the present invention in operative connection.
Figure 7:
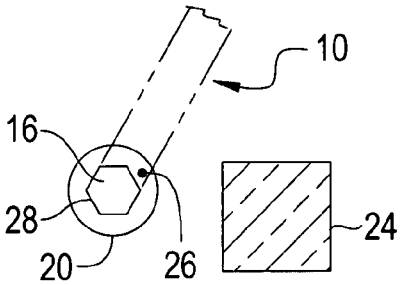
FIG. 7 is a plan view of portions of the present invention in operative connection.
Figure 8:
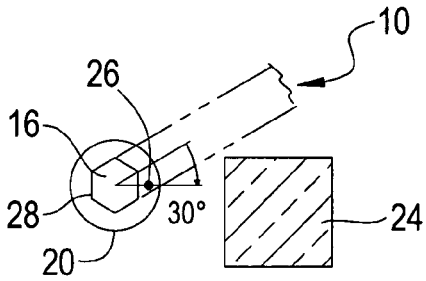
FIG. 8 is a plan view of portions of the present invention in operative connection.

Turning to FIGS. 5 through 8, therein is shown a series of drawings of the present invention 10 in operation in spatial relation to a proximate object 24 and alien screw 20. FIG. 5 shows the present invention 10 in a first position, wherein the wrench 10 is inserted into the socket 28 a screw 20. In FIG. 6, the wrench 10 rotates the screw 20 in a 60 degree arch toward object 24. In FIGS. 7 and 8, the wrench 10 has the ends 14, 16 of the top portion reversed as previously disclosed so that the screw 20 can then be rotated an additional 30 degrees by simply rotating the base stem 12 of the present invention 10 so that the opposite end of the top portion can be inserted into the screw 20 and the screw is thereafter rotated an additional 30 degrees toward object 24. The position dot 26 shows that a total of 90 degrees rotation is achieved by this operation.

The common hex key or "allen wrench" works well provided there is ample space available. However, as is often the case, space is very limited. In these situations, the common "L" shaped hex key has limitations. The reason is that you need 60 degrees of rotation to get the wrench back into the socket of the bolt or set screw when tightening the bolt or set screw. In operation, a user may have just enough space to rotate the wrench one "Flat" at a time. Once the screw is nearly tight, because of flex in the wrench, it is impossible to get that last rotation to securely tighten the screw. With the design of the present invention, the wrench can be rotated, then rotated back 30 degrees and placed back into the socket of the screw and the final tightening can be achieved.

What is claimed to be new and desired to be protected by Letters Patent is set forth in the appended claims.

I claim:

1. A wrench comprising:

a) a T-shaped body comprising a lower base member having a drive stem thereon and an upper straight cross member having first and second drive stems aligned along a common, straight central axis;

b) wherein said drive stem of said lower base member, said first drive stem and said second drive stem each are in cross section a polygon with a plurality of equal sides; and, c) wherein corresponding sides of said first and said second drive stems are angularly offset from each other around said axis.

2. The wrench of claim 1, wherein said drive stem of said lower base member, said first drive stem and said second drive stem each have six equal sides.

3. The wrench of claim 2, wherein said sides of said first and said second drive stems are angularly offset from each other thirty degrees around said axis.

4. A method for making a wrench comprising the steps of:

a) providing a T-shaped body having a lower base member having a drive stem thereon and an upper straight cross member having first and second drive stems aligned along a straight, common central axis;

b) wherein the drive stem of the lower base member, the first drive stem and the second drive stem each are in cross section a polygon with a plurality of equal sides; and, c) wherein corresponding sides of the first and second drive stems are angularly offset from each other around said axis.

5. The method of claim 4, wherein the drive stem of the lower base member, the first drive stem and the second drive stem each have six equal sides.

6. The method of claim 5, wherein the sides of the first and second drive stems are angularly offset from each other thirty degrees.

7. A method of using a wrench having a plurality of sides, comprising the steps of: providing a T-shaped body having a lower base member having a drive stem thereon and an upper cross member having a first and a second drive stem thereon, wherein the drive stem of the lower base member, the first drive stem and the second drive stem each have a plurality of equal sides, wherein the sides of the first and second drive stems are angularly offset from each other, wherein a user grasps the lower base member in his hand and places the first drive stem of the cross member in the drive socket of a screw, wherein the user then turns the screw a number of degrees, wherein the user removes the first drive stem from the drive socket of the screw, wherein the user rotates the lower base member to 180 degrees in his hand, wherein the user repositions the second drive stem of the cross member in the drive socket of the screw by rotating the lower base member backwardly 30 degrees in a horizontal plane, and, wherein the user places the second drive stem in the drive socket of the screw so that the user can then rotate the screw an additional 30 degrees.

* * * * *